US006267086B1

(12) United States Patent
Dingle et al.

(10) Patent No.: US 6,267,086 B1
(45) Date of Patent: Jul. 31, 2001

(54) FUEL SYSTEM

(75) Inventors: Philip John Gregory Dingle, Rochester, MI (US); Godfrey Greeves, Middlesex (GB)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/478,030

(22) Filed: Jan. 5, 2000

(30) Foreign Application Priority Data

Jan. 12, 1999 (GB) ..... 9900479

(51) Int. Cl.[7] ..... F02B 47/00
(52) U.S. Cl. ..... 123/25 R; 123/25 C; 123/575
(58) Field of Search ..... 123/25 R, 25 C, 123/25 J, 25 A, 575, 525, 526; 239/96, 575, 525, 526

(56) References Cited

U.S. PATENT DOCUMENTS 1,848,380 * 3/1932 Parks ..... 123/25 C
4,351,289 * 9/1982 Renda ..... 123/25 L
5,529,024 * 6/1996 Wirbeleit et al. ..... 123/25 C
5,762,033 * 6/1998 Rembold et al. ..... 123/25 C

FOREIGN PATENT DOCUMENTS

JP-8246979 * 9/1996 (JP) .

* cited by examiner

*Primary Examiner*—Henry C. Yuen
*Assistant Examiner*—Mahmoud Gimie
(74) *Attorney, Agent, or Firm*—Ohlandt, Greeley, Ruggiero & Perle, L.L.P.

(57) ABSTRACT

A fuel system comprising a unit pump/injector and a cam actuated plunger pump arranged to supply an auxiliary fluid to the injector, wherein the plunger pump is located adjacent the unit pump/injector.

12 Claims, 1 Drawing Sheet

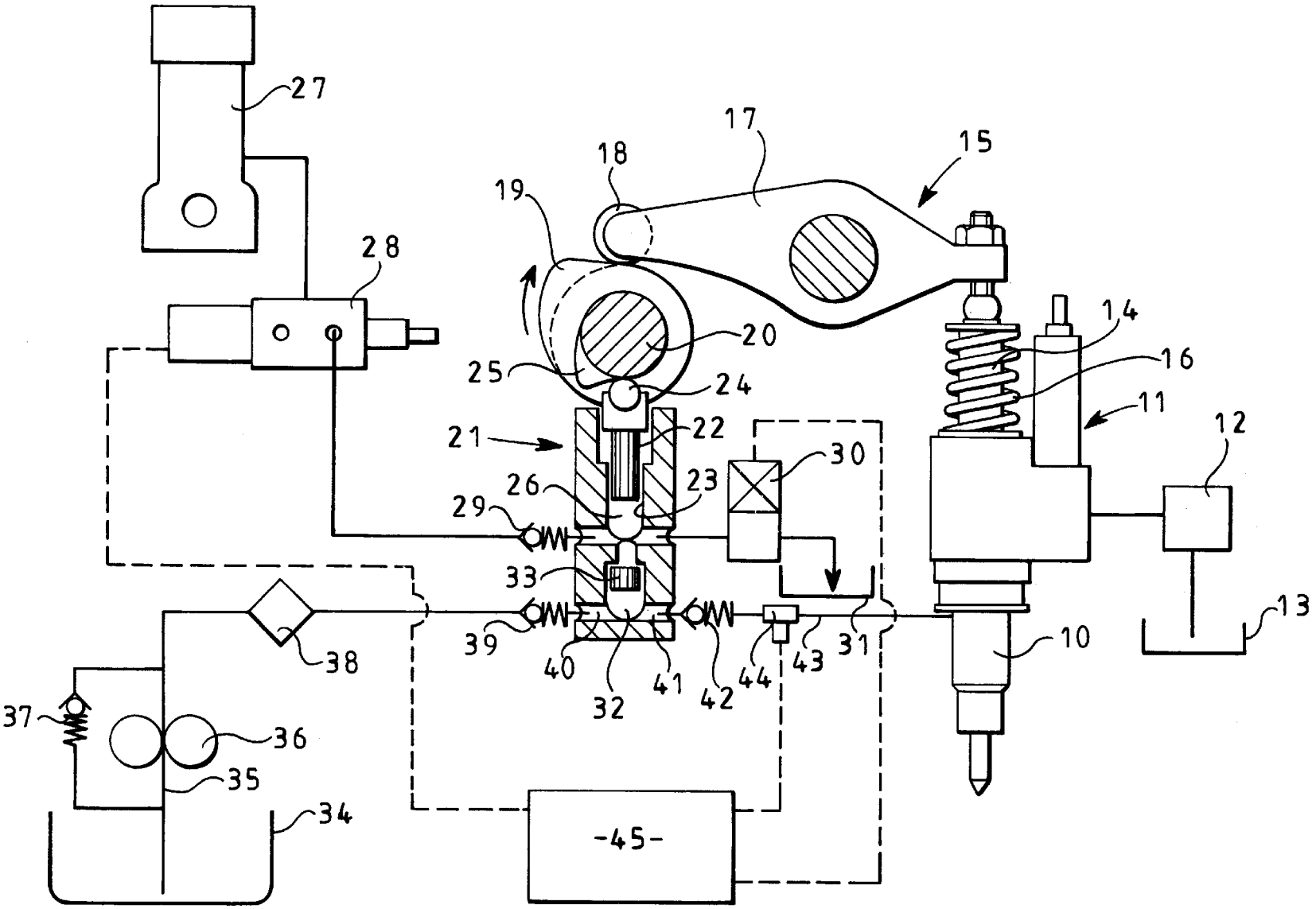
10
11
12
13
14
15
16
17
18
19
20
21
22
23
24
25
26
27
28
29
30
31
32
33
34
35
36
37
38
39
40
41
42
43
44
-45-

FUEL SYSTEM

This invention relates to a fuel system, and in particular to a fuel system of the type in which a unit pump/injector is used to supply both fuel and an auxiliary fluid, for example water, under pressure to a combustion space of an associated compression ignition internal combustion engine, and in which the auxiliary fluid is supplied to the injector independently of the supply of fuel, in use.

BACKGROUND OF THE INVENTION

A number of fuel systems of the type in which water is supplied to the combustion spaces of engines are known. For example, systems are known in which separate fuel and water injectors are associated with each combustion space. In a further known arrangement, water and fuel are supplied, independently, to a common injector used to deliver the fuel and the water to an engine combustion space.

Where the fuel and water are supplied to the injector separately, the water is typically supplied using a remote low pressure pump, the water flowing to the injector when the pressure within the injector is low. In such an arrangement, the timing of water supply to the injector and the quantity of water supplied are not controlled accurately. Where the pump is located remotely, if a water metering facility is provided, the large volume of pressurized water may result in the quantity of water delivered to the injector being difficult to control accurately.

SUMMARY OF THE INVENTION

According to the present invention there is provided a fuel system comprising a unit pump/injector, and a cam actuated plunger pump arranged to supply an auxiliary fluid to the injector, the plunger pump being located adjacent the unit pump/injector.

By locating the plunger pump adjacent the unit pump/injector, the plunger pump can be actuated by a cam mounted on the cam shaft, and thus can be made to deliver the auxiliary fluid, for example water, at predetermined points in the engine operating cycle. Further, by locating the plunger pump adjacent the injector, a reduced quantity of pressurized auxiliary fluid is present between the pump and the injector, thus metering can be improved.

The plunger pump is preferably provided with a metering device. The metering device may comprise an arrangement controlling the quantity of the auxiliary fluid supplied to the plunger pump, for example a shuttle metering system or an electromagnetically controlled valve arranged to permit fluid flow towards the plunger pump for a period of duration dependent upon the quantity of auxiliary fluid to be delivered to the injector.

In order to reduce corrosion and improve lubrication, the system may further comprise a piston member moveable under the influence of the pressure within a control chamber defined, in part, by the plunger of the plunger pump, the auxiliary fluid to be supplied to the injector being supplied, in use, to a pump chamber defined, in part, by a surface of the piston member, wherein the control chamber is arranged to be supplied with a control fluid to control the delivery of the auxiliary fluid to the injector. The control fluid may be supplied through a metering device, the quantity of control fluid determining the rest position of the piston member to control the volume of auxiliary fluid to be delivered. Alternatively, a spill valve may be provided to control the pressure of the control fluid within the control chamber, hence controlling when fluid is delivered to the injector.

To further reduce the risk of corrosion, the fuel system is conveniently provided with means permitting the auxiliary fluid to be purged from the system.

DESCRIPTION OF THE DRAWING

An embodiment of a fuel system in accordance with the invention will be described, by way of example, with reference to the sole FIGURE of the accompanying drawing.

DESCRIPTION OF THE INVENTION

The fuel system illustrated in the accompanying drawing comprises a unit pump injector 10 including a spill valve 11 controlling communication between a pumping chamber of the pump injector 10 and the outlet of a low pressure fuel pump 12 which is arranged to receive fuel from a fuel reservoir 13. The pumping chamber of the pump injector is defined, in part, by a surface of a pumping plunger 14 which is reciprocable under the action of a cam arrangement 15, against the action of a return spring 16. The cam arrangement is includes a pivotally mounted lever 17, an end of which is cooperable with the upper end part of the plunger 14, the other end of the lever 17 carrying a roller 18 which is arranged to ride over the cam surface of a cam member 19 mounted upon a cam shaft 20. As the cam shaft 20 rotates, the lever 17 pivots causing the pumping plunger 14 to reciprocate, causing pressurisation of the fuel within the pumping chamber at appropriate points in the operating cycle of the injector 10.

The pump injector 10 includes a delivery chamber which, in use, is arranged to receive fuel from the pumping chamber and is also supplied with water or an alternative auxiliary fluid. The following description is of a fuel system in which the auxiliary fluid is water, but it will be understood that other auxiliary fluids could be used. The water is supplied to the delivery chamber of the injector 10 by a cam actuated plunger pump 21 including a plunger 22 reciprocable within a bore 23. The plunger 22 carries a shoe having a roller 24 arranged to ride over the cam surface of a second cam member 25 mounted upon the cam shaft 20.

In a simple embodiment, the chamber defined between the plunger 22 and the bore 23 could be arranged to receive water under relatively low pressure, and to supply the water to the delivery chamber of the injector 10. It will be appreciated that such an arrangement is advantageous in that, as the pump 21 is operable under the influence of a cam mounted upon the same cam shaft as the cam member 19 used to operate the injector 10, the water is supplied to the injector 10 during predetermined periods in the operating cycle of the injector 10. Further, as the pump 21 is located adjacent the injector 10, a relatively small quantity of water is present in the lines interconnecting the pump 21 and the injector 10 at any instant. As a result, the volume of water delivered to the injector 10 can be controlled relatively accurately. If desired, the quantity of water supplied to the pump 21 may be controlled using an appropriate metering device, for example a shuttle metering system, or an electromagnetically actuable valve which is controlled to be open for a duration equivalent to the quantity of water to be delivered, thereby controlling the quantity of water delivered to the injector 10.

In another arrangement, the bore 23 is fully charged with water, a spill valve being located between the pump 21 and the injector 10 to control the timing of commencement of water pressurisation and delivery. The spill valve may also be used to terminate water delivery or, alternatively, termination of delivery may occur when or shortly after the plunger ceases inward movement. It will thus be appreciated that the timing of water delivery and the quantity of water delivered to the injector can be controlled.

It will be appreciated that in the arrangements described hereinbefore, where the pump 21 is used to supply water to the injector 10, movement of the plunger 22 within the bore 23 may be insufficiently lubricated, and the plunger 22 may become seized. Further, there is the risk of corrosion of these components. In the embodiment illustrated, in order to reduce the risk of corrosion and to improve lubrication of the movement of the plunger 22, the chamber defined between the plunger 22 and the bore 23 (referred to hereinafter as the control chamber 26) is not supplied with water, but rather is supplied, in use, with lubricating oil or an alternative control fluid from an appropriate reservoir 27, conveniently forming part of the engine lubrication system, through a metering device 28, for example a shuttle metering system or an electromagnetically actuable valve, and through a non-return valve 29. The control chamber 26 further communicates through an electromagnetically controlled spill valve 30 with a low pressure oil reservoir 31.

The bore 23 is of stepped form and defines, adjacent a blind end thereof, a pumping chamber 32. A piston member 33 is located within the bore 23, the piston member 33 having an upper surface which is exposed to the fluid pressure within the control chamber 26 and a lower surface which is exposed to the water pressure within the pumping chamber 32.

A reservoir 34 containing water communicates through a supply passage 35 with a low pressure pump 36. A pressure relief valve 37 is connected between the outlet and inlet of the pump 36 in order to avoid the generation of excessively high pressures downstream of the pump 36. The outlet of the pump 36 communicates through a filter 38 and an inlet non-return valve 39 with an inlet passage 40 which communicates with the pumping chamber 32. The pumping chamber 32 further communicates through an outlet passage 41 and an outlet non-return valve 42 with a passage 43 which communicates with the delivery chamber of the injector 10. A pressure sensor 44 is provided to monitor the pressure of the water within the passage 43.

An electronic controller 45 controls the operation of the metering device 28 and the spill valve 30 in response to the water pressure measurements taken using the pressure sensor 44 together with signals indicative of the cam and crank shaft positions and speeds. The output of the pressure sensor 44 can be used to determine whether or not water has been delivered to the injector 10.

In use, in the position illustrated, the plunger 22 occupies its outermost position, and the roller 18 is about to ride over the lobe of the cam member 19 to cause the pumping plunger 14 of the injector 10 to move inwardly, pressurizing the fuel in the pumping chamber. In due course, injection will take place. Subsequently, after the termination of injection, the plunger 14 is retracted, recharging the pumping chamber of the injector 10 with fuel through the spill valve 11.

It will be appreciated that the rotation of the cam shaft 20 will eventually result in the roller 24 riding over the cam lobe of the cam member 25, causing the plunger 22 to commence inward movement. In one mode of operation, prior to the instant at which it is desired to commence supplying water to the injector, the spill valve 30 is held in an open condition. It will be appreciated that under these circumstances, the inward movement of the plunger 22 will displace oil from the control chamber 26 through the spill valve 30 to the reservoir 31. As the pressure of the oil within the control chamber 26 will not rise significantly, the piston member 33 will not move from its illustrated, upper position. Water will not, therefore, be displaced from the pumping chamber 32.

When delivery of water is to commence, the spill valve 30 is closed under the control of the controller 45. As a result of the closure of the spill valve 30, and due to the presence of the non-return valve 29, the continued inward movement of the plunger 22 will pressurize the oil within the control chamber 26 and urge the piston member 33 in a downward direction. The inlet non-return valve 39 prevents water from escaping from the pumping chamber 32 towards the reservoir 34. The movement of the piston member 33 therefore pressurizes the water within the pumping chamber 32 and supplies the water through the passage 43 to the delivery chamber of the injector 10. The supply of water continues until either the spill valve 30 is returned to its open position, relieving the oil pressure within the control chamber 26, or the roller 24 rides over the nose of the cam lobe of the cam member 25.

After the delivery of water has terminated, and after the roller 24 has ridden over the nose of the cam lobe, as the oil pressure within the control chamber 26 is relatively low, the piston 33 will return to the position illustrated due to the supply of water to the pumping chamber 32 by the pump 36. If the spill valve 30 is closed during this part of the operation of the fuel system, it will be appreciated that the movement of the piston 33 will be transmitted through the oil within the control chamber 26 to the plunger 22, urging the plunger 22 towards the position illustrated.

The supply of water to the delivery chamber of the injector 10 charges the delivery chamber such that, upon subsequent inward movement of the plunger 14 of the injector 10, the water and fuel within the delivery chamber are mixed, the mixture or emulsion is pressurised and subsequently it is delivered by the injector to the associated combustion space of the engine. The quantity of water supplied to the injector 10 is preferably chosen to ensure that, after injection has been completed, none of the water remains within the injector as, if some water were to remain within the injector, a subsequent injection may contain an undesirably large quantity of water.

Rather than using the spill valve 30 to control the timing of commencement of water delivery, and also to control the termination of delivery of water, the spill valve 30 and metering device 28 may be used, in combination, to control the quantity of oil present within the control chamber 26. By appropriately controlling the quantity of oil within the control chamber 26, the piston 33 can be prevented from returning to its illustrated position, but rather held in an intermediate position. It will be appreciated that in such an intermediate position, the volume of water present within the pumping chamber 32 is restricted. Upon commencement of inward movement of the plunger 22, the pressure of oil within the control chamber 26 will rise, urging the piston member 33 in a downward direction as described hereinbefore, but as the quantity of water present within the pumping chamber 32 is limited, only a restricted, controlled volume of water is delivered to the delivery chamber of the injector 10. Clearly, using such an arrangement, the volume of water supplied to the injector 10 can be controlled.

The fuel system described hereinbefore is advantageous in that the movement of the plunger 22 is lubricated by the oil supplied to the control chamber 26, in use. The oil supplied to the control chamber 26 may also lubricate movement of the piston member 33.

In order to reduce the risk of corrosion further, when the engine is to be shut down, it is desirable to purge the system of water. This may be achieved by supplying compressed air through a solenoid controlled valve to the fuel system upstream of the inlet non-return valve 39 to force the water through the system, an additional valve being provided and controlled to allow water forced towards the passage 43 by the compressed air to return to the reservoir, thus clearing the fuel system of water. Upon restarting the engine, the additional valve is conveniently held open until all of the air has been removed from the system. If desired, rather then purging the system using compressed air, the fuel system could be purged using diesel fuel.

A solenoid controlled valve may be conveniently provided between the pump 21 and the injector 10 in each of the arrangements described hereinbefore. The provision of such a valve is advantageous in that, should it be determined that the supply of water to the injector 10 should cease, for example as a result of a change in the engine operating conditions, then the valve can be opened, preventing the generation of a sufficiently high water pressure to allow the water to enter the injector. It will be appreciated that opening the valve in this manner allows the supply of water to the injector to be terminated rapidly.

What is claimed is:

1. A fuel system comprising a unit pump/injector and a cam actuated plunger pump arranged to supply an auxiliary fluid to the injector, wherein said plunger pump is located adjacent said unit pump/injector, and a piston member moveable under the influence of pressure within a control chamber defined, in part, by a plunger forming part of said plunger pump.

2. The fuel system as claimed in claim 1, further comprising a pump chamber defined, in part, by a surface of said piston member, said auxiliary fluid to be supplied to said injector being supplied, in use, to said pump chamber, said control chamber being arranged to be supplied with a control fluid to control delivery of said auxiliary fluid to said injector.

3. The fuel system as claimed in claim 2, wherein said piston member has a rest position, said system further comprising a metering device through which a quantity of said control fluid is supplied, said quantity of control fluid determining said rest position of said piston member to control the volume of said auxiliary fluid to be delivered to said injector.

4. The fuel system as claimed in claim 2, further comprising a spill valve for controlling the pressure of said control fluid within said control chamber so as to control the timing of delivery of said auxiliary fluid to said injector.

5. The fuel system as claimed in claim 1, wherein said auxiliary fluid is water.

6. The fuel system as claimed in claim 1, wherein said plunger pump is provided with a metering device.

7. The fuel system as claimed in claim 6, wherein said metering device comprises an arrangement controlling the quantity of auxiliary fluid supplied to said plunger pump.

8. The fuel system as claimed in claim 7, wherein said metering device takes the form of a shuttle metering system.

9. The fuel system as claimed in claim 7, wherein said metering device takes the form of an electromagnetically controlled valve arranged to permit fluid flow towards said plunger pump for a period of duration dependent upon the quantity of auxiliary fluid to be delivered to said injector.

10. The fuel system as claimed in claim 1, further comprising a pressure sensor for measuring the pressure of auxiliary fluid supplied to said injector.

11. The fuel system as claimed in claim 1, further comprising an arrangement for permitting said auxiliary fluid to be purged from said system.

12. The fuel system as claimed in claim 11, further comprising a valve arrangement for supplying compressed air to said system to permit said auxiliary fluid to be purged from said system.

* * * * *